United States Patent [19]

Kienholz et al.

[11] Patent Number: 4,735,558

[45] Date of Patent: Apr. 5, 1988

[54] PERISTALTIC PUMP LATCHING MECHANISM

[75] Inventors: Charles M. Kienholz, San Dimas; Willis J. Bruns, Redlands; Keith W. Richey, Newhall; Mortaza Khanessari, Upland, all of Calif.

[73] Assignee: Staar Surgical Company, Monrovia, Calif.

[21] Appl. No.: 849,494

[22] Filed: Apr. 8, 1986

[51] Int. Cl.[4] ..... F04B 43/12; F04B 45/08

[52] U.S. Cl. ..... 417/477

[58] Field of Search ..... 417/474, 475, 476, 477; 418/45

[56] References Cited

U.S. PATENT DOCUMENTS

| | | | |
|---|---|---|---|
| 4,187,057 | 2/1980 | Xanthopoulos | 417/477 |
| 4,537,561 | 8/1985 | Xanthopoulos | 417/477 |
| 4,673,334 | 6/1987 | Allington et al. | 417/475 X |

*Primary Examiner*—Carlton R. Croyle
*Assistant Examiner*—Eugene Szczecina, Jr.
*Attorney, Agent, or Firm*—Frank Frisenda, Jr.

[57] ABSTRACT

A spring-loaded latching mechanism for a peristaltic pump that automatically sets and maintains a desired roller head tension. The spring-loaded latching mechanism includes a pair of counter-rotating latching cams positioned on opposite sides of a pump housing. Each latching cam has an indented or slotted portion for engaging a disposable tubing cassette. The disposable tubing cassette includes a length of flexible tubing supported by a circular race or channel. The latching cams are spring-loaded and, when the disposable tubing cassette is inserted into the pump housing, the latching cams urge the disposable cassette with its length of flexible tubing and circular race against a pump roller head to provide the desired roller head tension.

3 Claims, 2 Drawing Sheets

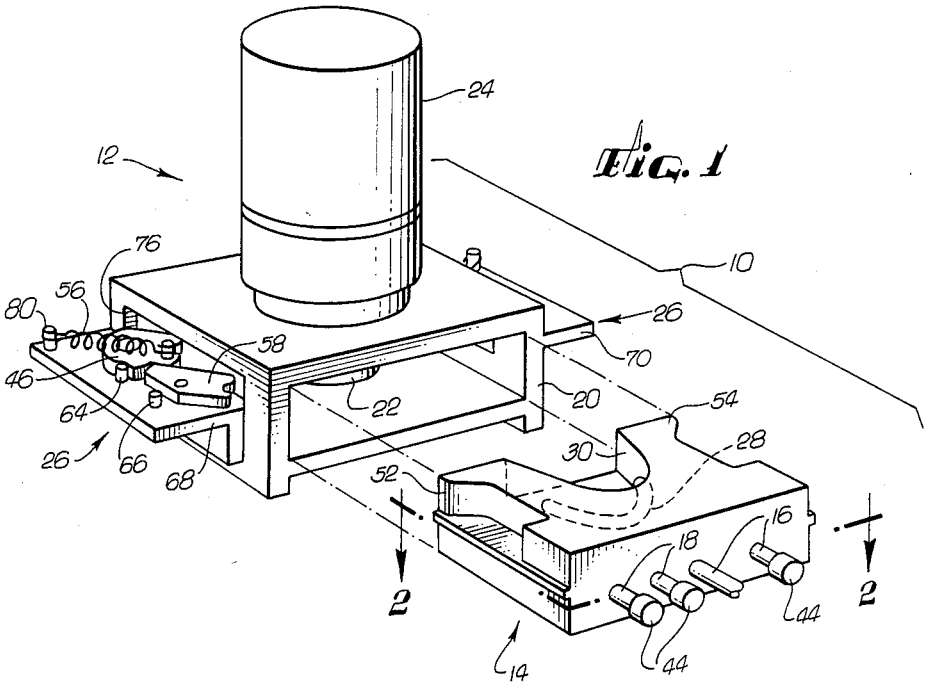
Fig. 1
Fig. 2
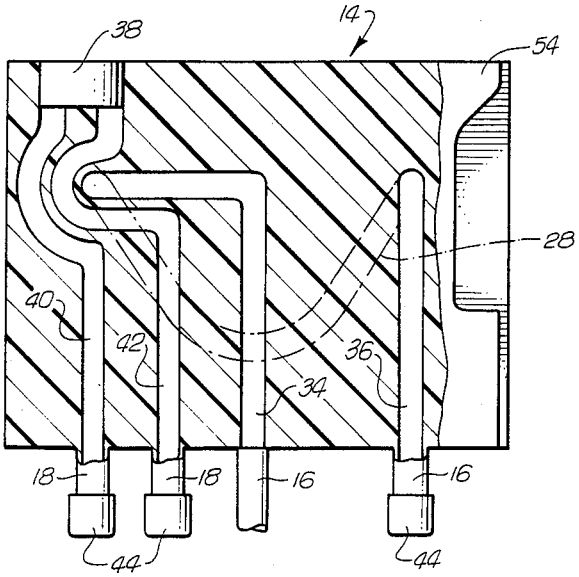

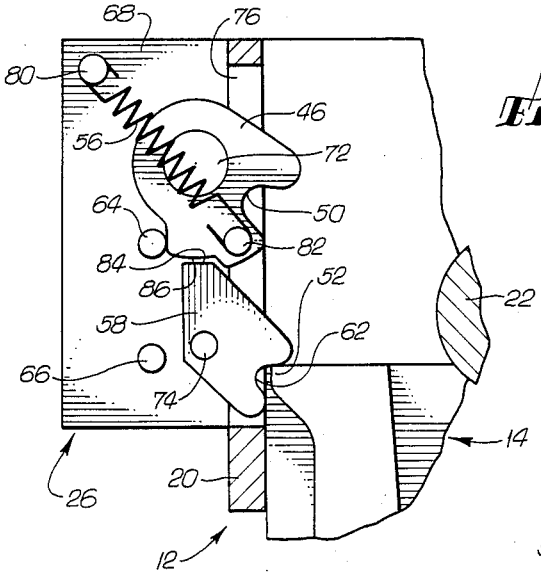
Fig. 3
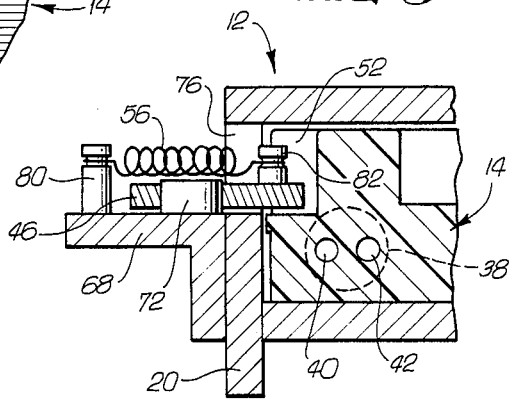
Fig. 5
Fig. 4
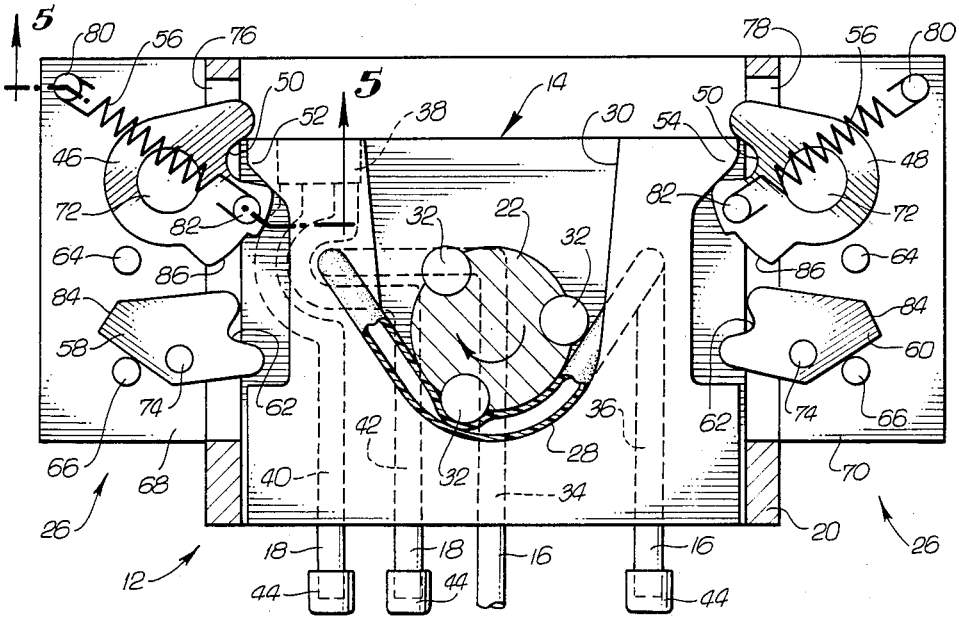

PERISTALTIC PUMP LATCHING MECHANISM

BACKGROUND OF THE INVENTION

This invention relates generally to peristaltic pumps and, more particularly, to mechanisms for adjusting the pumping action of peristaltic pumps.

Peristaltic pumps are mechanical devices that pump fluids in a wave-like motion by mechanical compression of a length of flexible tubing. In the medical field, peristaltic pumps are used in such devices as cardipulmonary bypass devices, for pumping blood, and in intraocular lens irrigation and suctioning devices, for pumping irrigation fluids. One particular type of peristaltic pump used frequently in these devices mechanically compresses the length of flexible tubing with a rotating roller head. The roller head has a plurality of rollers positioned about its circumference, which compress the length of flexible tubing against a circular race or channel, moving the fluid in the length of flexible tubing forward in the direction of the rotation of the roller head.

Efficient operation of this type of peristaltic pump requires that the pressure exerted by the roller head against the length of flexible tubing and the circular race be properly adjusted. Too much pressure causes excessive wear and bunching up of the length of flexible tubing, while too little pressure produces inefficient pumping action. A mechanism widely used in the past to adjust this roller head tension is a simple clamp and bolt mechanism. The clamp and bolt mechanism allows the position of either the roller head or the circular race to be adjusted by first loosening the bolts. The roller head or circular race is then rigidly clamped in place by tightening the bolts. Although simple, this mechanism is awkward and difficult to use. Furthermore, this mechanism does not automatically adjust the roller head tension, which is especially important with peristaltic pumps used in medical devices, because the length of flexible tubing must be removed and sterilized after each surgical operation. In addition, this mechanism does not provide a means for continuously adjusting the position of the roller head or the circular race while the pump is in operation, to maintain the proper roller head tension. Accordingly, there has been a need, particularly in the medical field, for an improved mechanism to easily, automatically and continuously adjust the position of the roller head or the circular race to provide the proper roller head tension. The present invention clearly fulfills this need.

SUMMARY OF THE INVENTION

The present invention resides in a spring-loaded latching mechanism for a peristaltic pump that automatically sets and maintains a desired roller head tension. Briefly, and in general terms, the latching mechanism includes a pair of spring-loaded latching cams that engage a disposable tubing cassette and urge a length of flexible tubing supported by the tubing cassette against a pump roller head to provide the desired roller head tension.

More specifically, in an intraocular lens irrigation and suctioning device embodying the invention, the latching mechanism includes a pair of spring-loaded, counter-rotating latching cams positioned on opposite sides of a pump housing. When in the open or disengaged position, the latching cams are locked in the open position by a pair of locking cams to prevent inadvertent rotation. Each of the latching and locking cams has an indented or slotted portion for engaging tabs projecting outwardly from the sides of the disposable tubing cassette when the cassette is inserted into the pump housing.

The irrigation and suctioning device provides peristaltic pumping of irrigation fluids to a surgical area during intraocular lens surgery. To use the device, the disposable tubing cassette, which is a sterile, disposable-plastic tubing and connector assembly used during just one operation and then discarded, is inserted into the pump housing. As the tubing cassette is first inserted into the pump housing, the locking cams engage the cassette tabs and are rotated by the tubing cassette, thus unlocking the latching cams. When the tubing cassette is inserted further into the pump housing, the spring-loaded latching cams engage the cassette tabs and urge the length of flexible tubing supported by the tubing cassette against the pump roller head. Pressure is exerted against the length of flexible tubing according to the spring constant of the particular latching cam springs that are being used, thus providing a desired roller head tension. During operation of the pump, the spring-loaded latching cams continuously adjust the position of the tubing cassette to maintain the desired roller head tension.

It will be appreciated from the foregoing that the present invention provides a simple and easy to use mechanism for automatically setting and maintaining a desired roller head tension. Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIG. 1 is a perspective view of an intraocular lens irrigation and suctioning device embodying the invention;

FIG. 2 is a sectional plan view of a disposable tubing cassette taken generally along the line 2—2 of FIG. 1;

FIG. 3 is an enlarged, fragmented plan view of a latching cam shown in the locked position;

FIG. 4 is a plan view of a disposable tubing cassette inserted into the irrigation and suctioning device and engaged by a pair of latching cams to provide a desired roller head tension; and FIG. 5 is a sectional elevation view of a latching cam taken generally along the line 5—5 of FIG. 4.

DESCRIPTION OF THE PREFERRED EMBODIMENT

As shown in the drawings for purposes of illustration, the present invention is embodied in a spring-loaded latching mechanism for a peristaltic pump that automatically sets and maintains a desired roller head tension. Peristaltic pumps are used in such medical devices as cardipulmonary bypass devices, for pumping blood, and intraocular lens irrigation and suctioning devices, for pumping irrigation fluids. Efficient operation of these peristaltic pumps requires that the roller head tension be properly adjusted. A mechanism widely used in the past to adjust the roller head tension is a simple clamp and bolt mechanism. However, the clamp and bolt mechanism is awkward and difficult to use, does not automatically set the roller head tension and does not maintain the proper roller head tension while the pump is in operation.

In accordance with the apparatus of the present invention, the spring-loaded latching mechanism includes a pair of counter-rotating latching cams positioned on oppostie sides of a pump housing. Each latching cam has an indented or slotted portion for engaging a disposable tubing cassette. The disposable tubing cassette includes a length of flexible tubing supported by a circular race or channel. The latching cams are spring-loaded and, when the disposable tubing cassette is inserted into the pump housing, the latching cams urge the disposable cassette with its length of flexible tubing and circular race against a pump roller head. Pressure is exerted against the length of flexible tubing according to the spring constant of the particular latching cam springs that are being used, thus providing a desired roller head tension. During operation of the pump, the spring-loaded latching cams continuously adjust the position of the tubing cassette to maintain the desired roller head tension.

FIG. 1 illustrates an intraocular lens irrigation and suctioning device 10 embodying the present invention. The irrigation and suctioning device 10 pumps irrigation fluids to and suctions waste materials from a surgical area during intraocular lens surgery. The irrigation and suctioning device 10 includes a pump assembly 12 and a disposable tubing cassette 14. The tubing cassette 14, which is a sterile, disposable-plastic tubing and connector assembly, is inserted into the pump assembly 12 for use during intraocular lens surgery. The tubing cassette 14 includes inlet/outlet ports 16 for attachment of irrigation tubing and instruments (not shown) and inlet/outlet ports 18 for attachment of suction tubing and instruments (not shown). The tubing cassette 14 is used during just one surgical operation and then discarded, thus greatly simplifying and significantly reducing the time required for sterilizing the irrigation and suctioning equipment.

As illustrated in FIG. 1, the pump assembly 12 includes a pump housing 20 into which the tubing cassette 14 is inserted, a pump roller head 22 to provide there peristaltic pumping of irrigation fluids, a pump motor 24 to rotate the pump roller head 22, and a spring-loaded latching mechanism 26 to automatically set and maintain a desired roller head tension. The suction motor is not shown. As illustrated in FIGS. 1, 2 and 4, the disposable tubing cassette 14 includes a length of flexible tubing 28 supported by a circular race or channel 30. When the tubing cassette 14 is inserted into the pump housing 20, a plurality of rollers 32 positioned about the circumference of the pump roller head 22 engage the length of flexible tubing 28. Rotation of the roller head 22 by the pump motor 24 compresses the length of flexible tubing 28 between the rollers 32 and the circular race 30, moving the irrigation fluid in the length of flexible tubing 28 forward in the direction of the rotation of the roller head 22, thus providing the peristaltic pumping action.

FIG. 2 illustrates, in detail, the disposable tubing cassette 14. The length of flexible tubing 28 is connected across the irrigation inlet/outlet ports 16 by a pair of conduits 34, 36.

FIGS. 3, 4 and 5 illustrate the spring-loaded latching mechanism 26. The spring-loaded latching mechanism 26 includes a pair of counter-rotating latching cams 46, 48 positioned on opposite sides of the pump housing 20. Each of the latching cams 46, 48 has an indented or slotted portion 50 for engaging tabs 52, 54 projecting outwardly from the sides of the disposable tubing cassette 14. Each of the latching cams 46, 48 is spring loaded by a spring 56. The latching cams 46, 48 are locked when in the open or disengaged position by locking cams 58, 60, respectively, to prevent inadvertent rotation of the latching cams. Each of the locking cams 58, 60 has an indented or slotted portion 62 for engaging the tabs 52, 54 of the disposable tubing cassette 14, thus unlocking the latching cams 46, 48 when the tubing cassette is first inserted into the pump housing 20. Each of the latching cams 46, 48 has a stop 64 against which the latching cams rest when in the open or disengaged position and each of the locking cams 58, 60 has a stop 66, insuring that the latching and locking cams are in a position to engage the cassette tabs 52, 54 when the tubing cassette 14 is inserted into the pump housing 20.

The latching cams 46, 48 are rotatably attached to left and right mounting brackets 68, 70, respectively, with vertical spindles 72. The locking cams 58, 60 are rotatably attached to the left and right mounting brackets 68, 70, respectively, with vertical spindles 74. The vertical spindles 72, 74 are rigidly attached to the top surfaces of the mounting brackets 68, 70, and the mounting brackets 68, 70 are rigidly attached to the sides of the pump housing 20. The slotted portions 50, 62 of the latching and locking cams engage the tabs 52, 54 of the tubing cassette 14 by extending through left and right slots 76, 78 in the pump housing 20. The springs 56 are attached at one end to vertical posts 80 and at the other end to vertical posts 82. The vertical posts 80 are rigidly attached to the mounting brackets 68, 70 and the vertical posts 82 are rigidly attached to the latching cams 46, 48.

To use the intraocular lens irrigation and suctioning device 10 during surgery, the disposable tubing cassette is inserted into the pump housing 20. As shown in FIG. 3, when the tubing cassette 14 is first inserted into the pump housing 20, the locking cams 58, 60 engage the cassette tabs 52, 54, respectively. As the tubing cassette 14 is inserted further into the pump housing 20, the locking cams 58, 60 rotate and disengage a locking surface 84 at the edge of each of the locking cams 58, 60 from a locking surface 86 at the edge of each of the latching cams 46, 48, thus unlocking the latching cams 46, 48. Because the centerline of each of the springs 56 is forward of the center of each of the sprindles 72, the latching cams 46, 48 remain in the open or disengaged position, pulled against the stops 64 by the springs 56.

As shown in FIG. 4, when the tubing cassette 14 is inserted further into the pump housing 20, the latching cams 46, 48 engage the cassette tabs 52, 54, respectively. As the tubing cassette 14 is inserted still further into the pump housing 20, the latching cams 46, 48 being to rotate. Once the centerline of each of the springs 56 is aft of the center of each of the spindles 72, the springs 56 rotate the latching cams 46, 48, urging the length of flexible tubing 28 and circular race 30 of the tubing cassette 14 against the pump roller head 22. Pressure is exerted against the length of flexible tubing 28 and circular race 30 according to the spring constant of the particular springs 56 that are being used, thus providing a desired roller head tension. During operation of the pump 10, the spring-loaded latching cams 46, 48 continuously adjust the position of the tubing cassette 14 to maintain the desired roller head tension.

After surgery, the disposable tubing cassette 14 is simply removed from the pump housing 20 and discarded. Pulling the tubing cassette 14 from the pump housing 20 rotates the latching cams 46, 48 until the centerline of each of the springs 56 is forward of the center of each of the spindles 72. At that point, the latching cams 46, 48 are pulled against the stops 64, into the open or disengaged position, by the springs 56. Pulling the tubing cassette 14 further from the pump housing 20 rotates the locking cams 58, 60 until the locking surface 84 at the edge of each of the locking cams 58, 60 is engaged with the locking surface 86 at the edge of each of the latching cams 46, 48, thus locking the latching cams 46, 48. The pump assembly 12 is now ready for another disposable tubing cassette 14.

From the foregoing, it will be appreciated that the present invention provides a simple and easy to use mechanism for automatically setting and maintaining a desired roller head tension. Although a preferred embodiment of the invention has been shown and described, it will be apparent that other adaptations and modifications can be made without departing from the spirit and scope of the invention. Accordingly, the invention is not to be limited, except as by the following claims.

We claim:

1. A latching mechanism having locking cams and latching cams for a peristaltic pump that provides a prescribed roller head tension said mechanism comprising in combination:

a disposable tubing cassette having a length of flexible tubing and means for supporting the length of flexible tubing and further including tabs projecting outwardly from the sides of the tubing cassette for engagement by a pair of locking cams and a pair of latching cams;

a pump housing into which the disposable tubing cassette is inserted;

a pump roller head rotatably attached to said pump housing;

a pair of spring-loaded latchhcing cams rotatably attached to the sides of the pump housing for engaging the disposable tubing cassette and urging the length of flexible tubing and means for supporting the disposable tubing cassette against the pump roller head to provide the prescribed roller head tension; each of said latching cams including an indented portion for engaging the disposable tubing cassette, for unlocking the latching cams when the disposable tubing cassette is first inserted into the pump housing and locking the latching cams when the disposable tubing cassette is removed from the pump housing; and a pair of locking cams rotatably attached to the sides of said pump housing which along with the pair of springs lock the latching cams when the latching cams are disengaged from the disposable tubing cassette.

2. The latching mechanism as set forth in claim 1, wherein the pump roller head includes a plurality of rollers positioned about the circumference of the roller head.

3. The latching mechanism as set forth in claim 1, wherein the means for supporting the length of flexible tubing includes a circular race.

* * * * *